United States Patent [19]

Visconti

[11] 4,122,662

[45] Oct. 31, 1978

[54] WRIST WATCH IDENTIFICATION

[75] Inventor: Gérald Visconti, Bellach, Switzerland

[73] Assignee: A. Schild S.A., Switzerland

[21] Appl. No.: 792,856

[22] Filed: May 2, 1977

[30] Foreign Application Priority Data

May 14, 1976 [CH] Switzerland ..... 6073/76

[51] Int. Cl.[2] ..... G04B 17/00; G04B 33/00

[52] U.S. Cl. ..... 58/59; 58/107

[58] Field of Search ..... 58/59, 88 R, 104, 107, 58/117

[56] References Cited

FOREIGN PATENT DOCUMENTS 8,527 5/1894 Switzerland ..... 58/104

115,561 7/1926 Switzerland ..... 58/104

*Primary Examiner*—Stanley J. Witkowski

*Attorney, Agent, or Firm*—Stevens, Davis, Miller & Mosher

[57] ABSTRACT

This invention relates to the identification of wrist watches of the type which are mass produced. It comprises stamping a matrix of identifying indicia in the bottom of a concavity underneath but visible through the felloe of the balance.

4 Claims, 2 Drawing Figures

WRIST WATCH IDENTIFICATION

Figure 1:
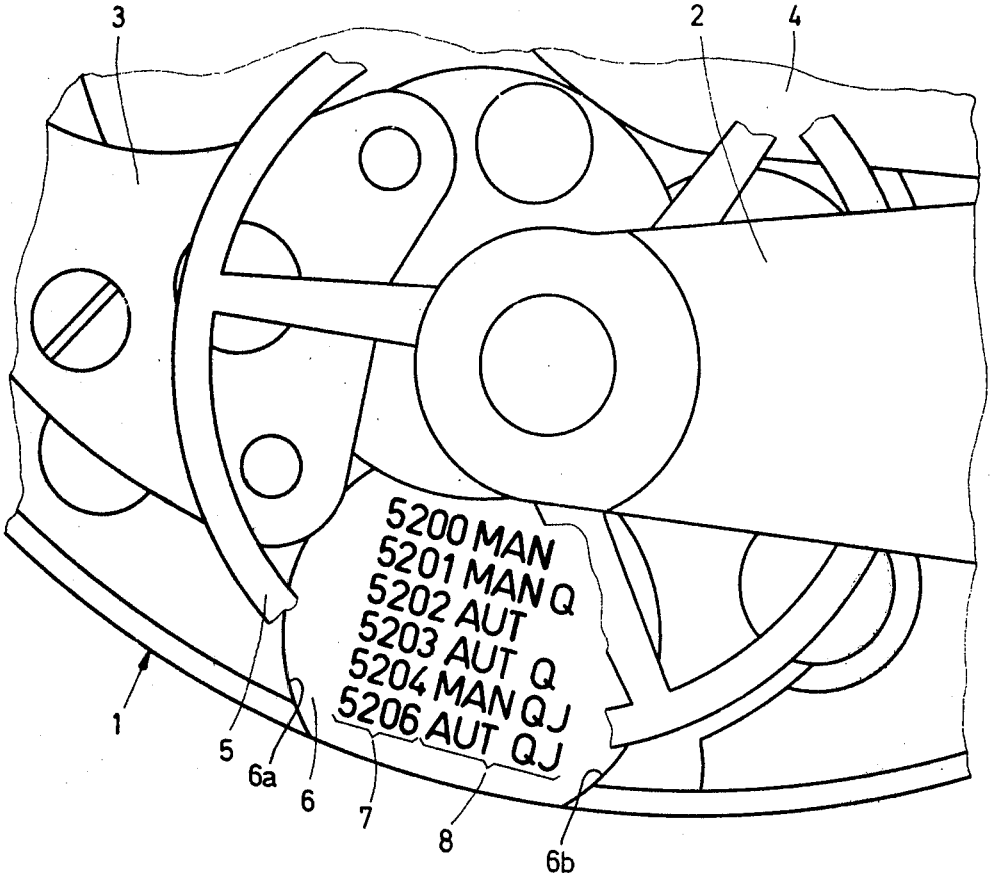

One knows that the construction of wrist watch movements is evolving towards uniformity and standardization of the different calibers. In particular efforts are being made to achieve families of calibers which utilize as much as possible, interchangeable parts, particularly platins which are completely identical. One family of calibers will comprise for example a base caliber which will be a hand wound movement without a calendar and derived calibers going from the simple calendar to the calendar with days of the week, and from manual to automatic winding. These different features offer a whole series of different calibers for which the same platin can serve.

Swiss patent CH No. 8527 describes a platin capable of being utilized for several different movements. It relates, however, to striking watches and thus to products which were not mass produced.

However, the effort to standardize in mass production has caused an unexpected problem to arise, that of the marking of the platins. Indeed, it is the current practice in mass producing watches that the platin for a movement carry the number of its caliber so as to permit not only the storage and classification of parts in the factory or place of assembly but the ordering of replacement parts by the watch repairman. A replacement part is always ordered with an indication of the number of the caliber, the said number being read by the repairman on the platin.

It is not possible to give up marking platins because, on the one hand, it is the custom in the watch industry and necessary to after sale service and on the other hand for administrative reasons, marking having been required by certain customs regulations.

The practice of having standard platins for several sizes creates a marking problem because of the fact that if, after making a series of platins, they are divided and marked differently according to the calibers of which they will become the base, most of the advantages of standardization of platins are lost. Since marking is generally done by stamping, it is of advantage to be able to incorporate this operation at the most favorable moment in the series of manufacturing operation but this condition implies that all of the platins of a series be marked in the same manner. If this is done, however, it results in difficulties of identification either at the moment of passing through customs or in the purchase of a repair part.

The efforts which have been made to solve the problem by effecting marking by sticking little plaques on the platin after manufacture, have proved to be of little worth.

The object of the present invention is to permit a reasonable manufacture of platins for wrist watches by making a single wrist watch platin, suitable for several calibers of a family of calibers which is marked by stamping and which avoids difficulties of identification.

Within this objective the present invention has for an object a wrist watch platin capable of being incorporated at will in various calibers of the same family and provided with a marking characterized in that the marking is constituted by a table comprising a series of numbers designating the said calibers and identification marks in registry with the caliber numbers.

It is already known, notably by Swiss Patent 115, 561, to have watch parts bearing distinctive marks in the form of drawings, calling attention to a function. However, that patent relates to the rear walls of alarm clocks, the markings on which identify the rewinding key of the spring motor and the alarm.

Figure 2:
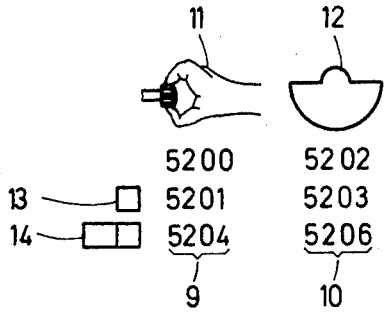

There is described below, by way of example, an embodiment of the invention and a variant of said embodiment, reference being made to the drawings of which:

FIG. 1 is a partial view in plan of the bridge side of a watch movement provided with one embodiment of the present invention, and FIG. 2 is a schematic view showing another distribution of markings according to the present invention.

The movement partially shown in FIG. 1 comprises a platin 1 on which one sees in the drawing a peripheral zone of the internal face on which are fixed a balance cock 2, a pallets bridge 3 and a combined bridge 4. A balance wheel 5 is mounted between the cock and the platin and its felloe passes near the edge of the platin 1. Under the felloe of the balance and between the edge of the platin 1 and the axis of the balance, the platin has a recess 6 with a flat bottom defined by two arcuate edges **6*a* and 6*b*. In the bottom of this recess 6 there is stamped a table 7,8 which constitutes the marking of the platin and which comprises a series of numbers of calibers arranged in a column 7 and a second column 8 disposed adjacent said column 7, each mark in said column 8 being in registry with a caliber number in column 7**. In the example described, the identification marks are letters which correspond to equipment of the caliber indicated by the corresponding number. One understands, for example, that the identifying mark MANQJ indicates a manual wind caliber, the letters MAN indicating the hand. Additionally, this caliber is provided with a calendar mechanism with a date indicator −Q= date and indicator of day of the week −J= day. The mark AUT, on the other hand, corresponds to an automatic winding caliber. If the marking includes only AUT or MAN it indicates automatic or manual wind without a calendar.

The table 7,8 could also be located elsewhere on the platin.

The making of a table of marks on watch movement platins was found, after testing, to be perfectly efficacious. First the storage of platins, whether in a factory or in a place of business which does the assembly, causes no difficulty and in particular it is no longer necessary to take the trouble to verify whether the platins with which a certain caliber of the family is equiped carry the right number.

Furthermore, experiments made in the service after sale area establish that the marking of platins by a table as shown in the drawing doesn't in any way create problems in respect to the exchange of parts. Indeed the repairmen known by habit that to order a repair part they must tell the factory the caliber number. The repairman who receives a movement having a platin like platin 1 easily understands that it suffices to locate on the table which number corresponds to the construction which he has in hand to know which caliber number to write in the order. For a repairman, the identification, that is to say the determination of the type of movement that he has in his hands, is instantaneous. The parts and mounting mechanisms are indeed perfectly visible.

Aside from the arrangement shown in FIG. 1, the marking table of the platins of a family of calibers can also be otherwise done. FIG. 2, in particular, represents a stamped marking where the numbers of calibers are divided into two columns 9 and 10 of three lines each. One of the columns corresponds to calibers which are hand wound and the other to automatics. They are indicated by a symbol 11 or 12 permitting easy location in use. in an other variant the symbols 11 or 12 could be replaced by letters MAN or AUT.

The lines of the matrix 9,10 correspond to variations in display. The first line corresponds to the usual display without a calendar, the second to display of date only and the third to display of date and day of the week. The marks 13 and 14 symbolize the form of the little windows in the two forms of calendar watches. Instead of marks 13 and 14 one could equally well envisage in the same place the letters Q and QJ being initials in the French language for date and date and day respectively.

It is, of course, understood that the platin described above can also bear other marks such as the conventional platins which bear in general the trademark of the maker of the blank and if necessary the mark of the manufacturer or finisher. The platin described above being of metal the marking is effected by stamping. Nevertheless any other indelible marking system can be employed. In the case of a moulded platin, in plastic material for example, the marking can be effected by die casting, the table being reproduced in relief on the wall of the mold.

What is claimed is:

1. A wrist watch movement comprising a platin with an inside face and a peripheral edge, a balance cock secured on said platin, a balance wheel mounted between said cock and said platin said balance wheel having a felloe passing near said peripheral edge, a flat recess in said inside face of the platin, visible through said felloe and a double series of markings provided within said flat recess, one of said series of markings being formed of numbers.

2. A wrist watch movement according to claim 1 in which the series of markings includes at least one figure stamped in the platin.

3. A wrist watch movement according to claim 1 in which said double series of markings comprises caliber numbers arranged in one column and identification marks in a second parallel column, each identifying mark corresponding to a caliber number.

4. Wrist watch movement according to claim 1 in which the series of markings comprises a matrix of caliber numbers, the identification marks being located with respect to the lines and columns of the matrix.

* * * * *